US005098246A

United States Patent [19]

Jung

[11] Patent Number: 5,098,246

[45] Date of Patent: Mar. 24, 1992

[54] APPARATUS FOR SOLID PARKING INSTALLATION

[76] Inventor: Soo-Cheol Jung, 194, Jaeun-Dong, Jinhae, Kyungsangnam-Do, Rep. of Korea

[21] Appl. No.: 452,105

[22] Filed: Dec. 18, 1989

[30] Foreign Application Priority Data

Dec. 27, 1988 [KR] Rep. of Korea ..... 88-17584

[51] Int. Cl.[5] ..... B65G 1/06

[52] U.S. Cl. ..... 414/239; 414/264; 414/282; 414/283

[58] Field of Search ..... 414/234, 239, 240, 253, 414/255, 256, 259, 260, 264, 281-283, 660-663; 187/8.59, 24

[56] References Cited

U.S. PATENT DOCUMENTS

| | | | |
|---|---|---|---|
| 2,511,619 | 6/1950 | Bowser | 414/264 |
| 2,845,189 | 7/1958 | Sanders | 414/256 |
| 2,876,913 | 3/1959 | Roth et al. | 414/253 |
| 2,951,599 | 9/1960 | Bogar | 414/264 X |
| 3,155,246 | 11/1964 | Baume | 414/240 X |
| 3,556,329 | 1/1971 | Johnston et al. | 414/663 |
| 3,738,506 | 6/1973 | Cornford et al. | 414/283 X |
| 3,779,403 | 12/1973 | Young | 414/281 X |
| 3,782,565 | 1/1974 | Doran et al. | 414/281 X |
| 4,776,746 | 10/1988 | Peng | 414/253 |

FOREIGN PATENT DOCUMENTS

| | | | |
|---|---|---|---|
| 1272826 | 7/1968 | Fed. Rep. of Germany | 414/663 |
| 2135719 | 2/1973 | Fed. Rep. of Germany | 414/281 |
| 1280795 | 11/1961 | France | 187/8.59 |
| 503359 | 12/1954 | Italy | 414/261 |
| 158669 | 3/1963 | U.S.S.R. | 414/281 |
| 691359 | 10/1979 | U.S.S.R. | 414/281 |
| 1064541 | 4/1967 | United Kingdom | 414/259 |
| 4107 | 7/1986 | World Int. Prop. O. | 414/253 |

*Primary Examiner*—David A. Bucci

*Attorney, Agent, or Firm*—Beveridge, DeGrandi & Weilacher

[57] ABSTRACT

An apparatus for a solid parking installatin to load several automobiles in a limited space is disclosed herein. This apparatus includes a solid parking installation of the apartment type which has a plurality of floors and loading spaces that are mutually crossed and assembled from H-shaped steel. Chains for driving are mounted to the horizontal shaped beams, the position of the chains being determined by the height of the solid parking installation. Wires and extensible springs are connected to one end of the chains. A cage is provided for moving along a guide rail, the guide rail being installed at one side of the solid parking installation. A system for shifting the cage to the right and left, is installed within the cage, which cooperates with a system for shifting the cage to the right and left, located along the horizontal H-beams. A motorized system for rotating a table, fixed to the cage is included. Finally a system for controlling the tension of the chain is included. The table includes pallets which are attracted and stretched for delivering and depositing an automobile to be parked within loading spaces in the parking installation.

5 Claims, 11 Drawing Sheets

APPARATUS FOR SOLID PARKING INSTALLATION

FIELD OF THE INVENTION

This invention relates to an apparatus for a solid parking installation to load several automobiles in a limited amount of space.

BACKGROUND OF THE INVENTION

At the present time, a great number of automobiles are being driven in the downtown area of large cities, and the number of automobiles is increasing rapidly day by day. But the available parking systems cannot accommodate the growing number of automobiles, which makes traffic jams at the center of these cities even worse. These problems are caused by the need for a large number of parking spaces at the limited space in the center of the city, and the high cost to install a parking system because of the very high price of real estate. To overcome these problems, solid buildings have been constructed which are used exclusively for parking. However, it is necessary for these solid buildings to occupy a large space, and they require a very high cost for equipment. In the system of solid buildings, because of the problem of driving within the building, each automobile must move to a parking position in the interior of the building, eventually resulting in aggravating traffic jams within the building itself.

Also, an apparatus is known which is used to park several automobiles vertically in the parking space of only one automobile. This apparatus is made from shaped steel usually constructed as the piling up type. This apparatus is equipped with a separate elevator for each vertical column, the elevator being used to lift an automobile placed in a suitable position. Because each vertical column of a parking system of the piling up type must be equipped with an elevator, a large space and a high initial investment for equipment cost is needed. This piling up type system eases the traffic jams at the center of the city somewhat, but eventually, it is not more helpful for solving a traffic problem than the solid building described above.

Also, there is a parking apparatus of the circulation type, which comprises multiple rectangular cages centered on a supporting bar. As said cage circulates continuously on a circle of a rectangular type, many automobiles can be deposited. Accordingly, as a parking installation, many automobiles can be parked in a minimal amount of space.

But, there are problems with the circulation type apparatus. If one wants to deposit an automobile or take an automobile out of the cage sometime after being deposited, at of the cages must be circulated until the particular cage needed is moved to the entrance. Therefore, extra safety devices must be included, in view of the large amount of circulation of each cage, thereby increasing the investment for equipment. Also, at the present time, a great number of automobiles must be parked on the limited space; therefore, the circulation method is not sufficient because only a limited number of cages may be centered on the supporting bar.

SUMMARY OF THE INVENTION

In view of the foregoing, it is a primary object of this invention to provide an efficient parking apparatus to ease the traffic jams at the center of a city. The parking apparatus in accordance with this invention is the same type as the apartment type, having suitable partitions and floors, constructed of H shaped steel beams assembled so as to provide loading spaces for automobiles.

Within the apparatus, a cage of the elevator type is installed to shift automobiles to the left or right direction. The cage elevator includes pallets which are constructed to expand and stretch in said cage, whereby the delivering and depositing of the automobiles is performed. A rotary type table, equipped with pallets which can be rotated at 360 degrees, is used to park an automobile at any angular position, regardless of the initial position of the automobile.

Additionally, on the upper shaped steel beam of each vertical axis comprising the cage elevator, a group of driving means are installed, and on the inside of each vertical axis, a means for shifting up and down is mounted therein, using chains as a power transferring means.

Furthermore, since chains are tied up on the edges of a fixing foundation member, the cage elevator is operated, after lifting or lowering by another driving means, so as to provide horizontal motion. Therefore, after an automobile is deposited in a cage by a pallet, the cage is moved to another position, as directed by an operator, by freely shifting up and down. The apparatus provides a limited space in which to park a great number of automobiles.

A further object of this invention is to minimize the installation cost of the apparatus by providing a simple assembly.

Another object of this invention is to maximize the efficiency of the parking apparatus by enabling the automatic performance of the delivering and depositing operations, which is accomplished by free moving the cage of the elevator type, and automatically performing the delivering and depositing operations by the pallet.

BRIEF DESCRIPTION OF THE DRAWING

The foregoing and other advantageous features of the invention, together with novel details and combinations of parts, will now be more particularly described in conjunction with an illustrative embodiment and with reference to the accompanying drawings thereof, in which.

DESCRIPTION OF THE PREFERRED EMBODIMENTS

Figure 1:
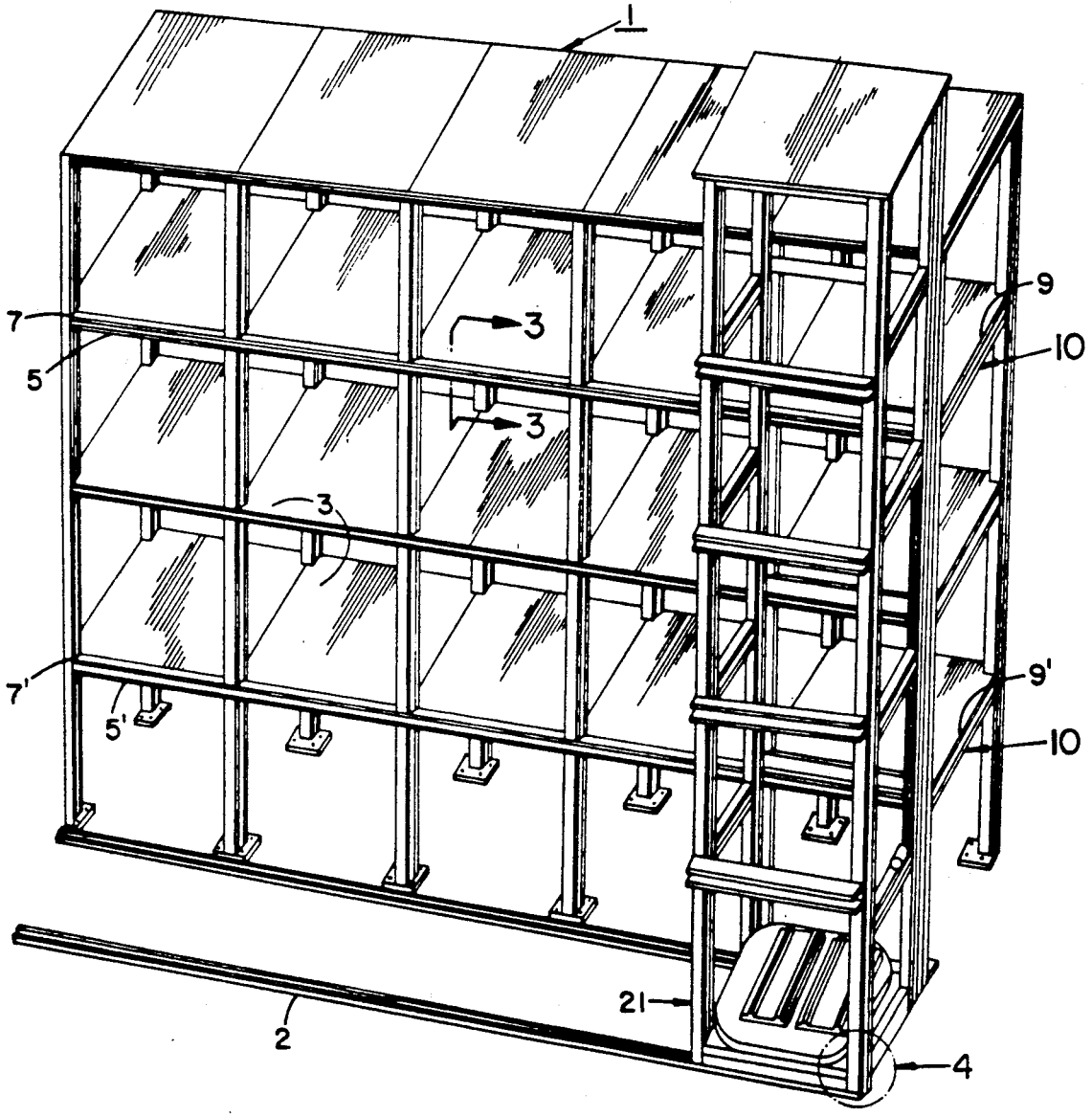
FIG. 1 is a perspective view of an illustrative apparatus of the present invention.

The present invention comprises a solid parking installation 1 of the piling up type, which includes a cage 21 of the elevator type, which automatically performs the operation of delivering and depositing automobiles by shifting the cage to the right and left along a guide rail 2 equipped on either side of said parking installation 1. The parking installation 1 comprises, as shown in FIG. 1, H shaped steel beams having superior solidity, which are mutually crossed, to thereby form loading spaces 3. Accordingly, a parking installation 1 can be constructed by controlling the numbers of floors and walls in proportion to the space needed for each individual loading space 3.

Figure 10:
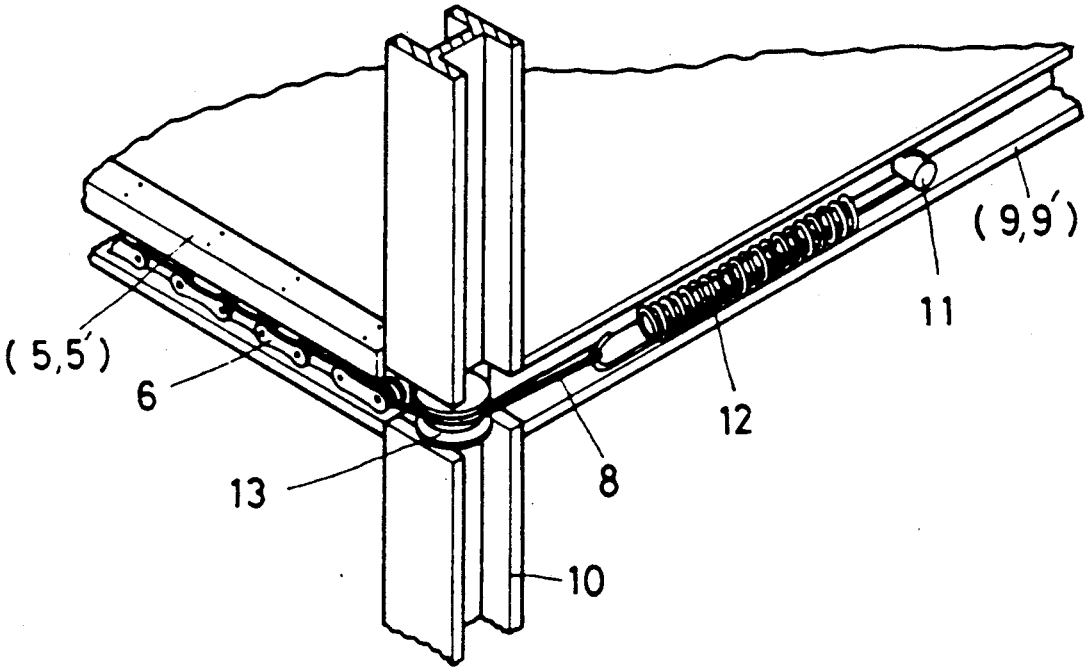
FIG. 10 is a schematic perspective view of area F shown in FIG. 1.

The inner side of H shaped steel beam 5,5' for horizontal supporting, positioned suitably according to the height of said vertical beam, is equipped with a chain 6 for driving a cage of the elevator type. This part of the apparatus will be described in more detail hereinafter. One end of said chain 6 is fastened to a pin 7 for fixing. At another side of the horizontal H beams 5,5', the other end of said chain 6 is connected to the wire 8 of desirable length, as shown in FIG. 10. The wire 8 is attached to a very extensible spring 12. The extensible spring 12 is equipped between side H beams 9,9'; which are connected to said horizontal beams 5,5; and one end of said spring 12 is fastened to a fixing member 11 located on the side H beam 9,9'. The other end of said spring 12 is fastened to said wire 8.

On the vertical H beam 10 (FIG. 10), which is located between said horizontal H beams 5,5' and said side H beams 9,9', a rotary roller is included. The wire 8 for connecting said spring 12 to said chain 6 is passed around this rotary roller.

The rotary roller, wire 8, extensible spring 12, and fixing member 11 ar to prevent the lengthening of the chain 6 because of the weight of the cage 21 during shifting to the right and the left. Accordingly, said chain 6 always receives an attractive force by said extensible spring 12 connected to wire 8, and furthermore, the shifting of cage 21 may be performed accurately because of the continuous tension of said spring 12. The number of places equipped with a chain 6 is chosen based on the height of the parking installation 1, for example, only one chain 6 may be necessary, or more than two chains may be required.

Cage 21 of the elevator type, is made in accordance with the width of one loading space 3. The cage elevator 21 is also constructed one floor higher than the height of said loading spaces 3, and it is assembled from shaped steel. The cage 21 is rectangular, being constructed from vertical H beams 36, 36' 36'', 36''' (see FIG. 2), having a caster for shifting on the bottom of said vertical H beam. Within the cage 21, a foundation member 22 (see FIG. 8) for fixing is installed, such that the foundation member 22 is located within the inside of said vertical H beams 36, 36', 36'', 36'''. A table 23 and pallets 24 are installed on the foundation member 22.

The cage 21 mainly comprises means for shifting right and left 31, means for rotating the table 51, means for shifting up and down 61, means for controlling the tension of the chain, and means for expansion and stretch of pallets 101 These features of the cage 21 will be described in more detail herein below.

Figure 2:
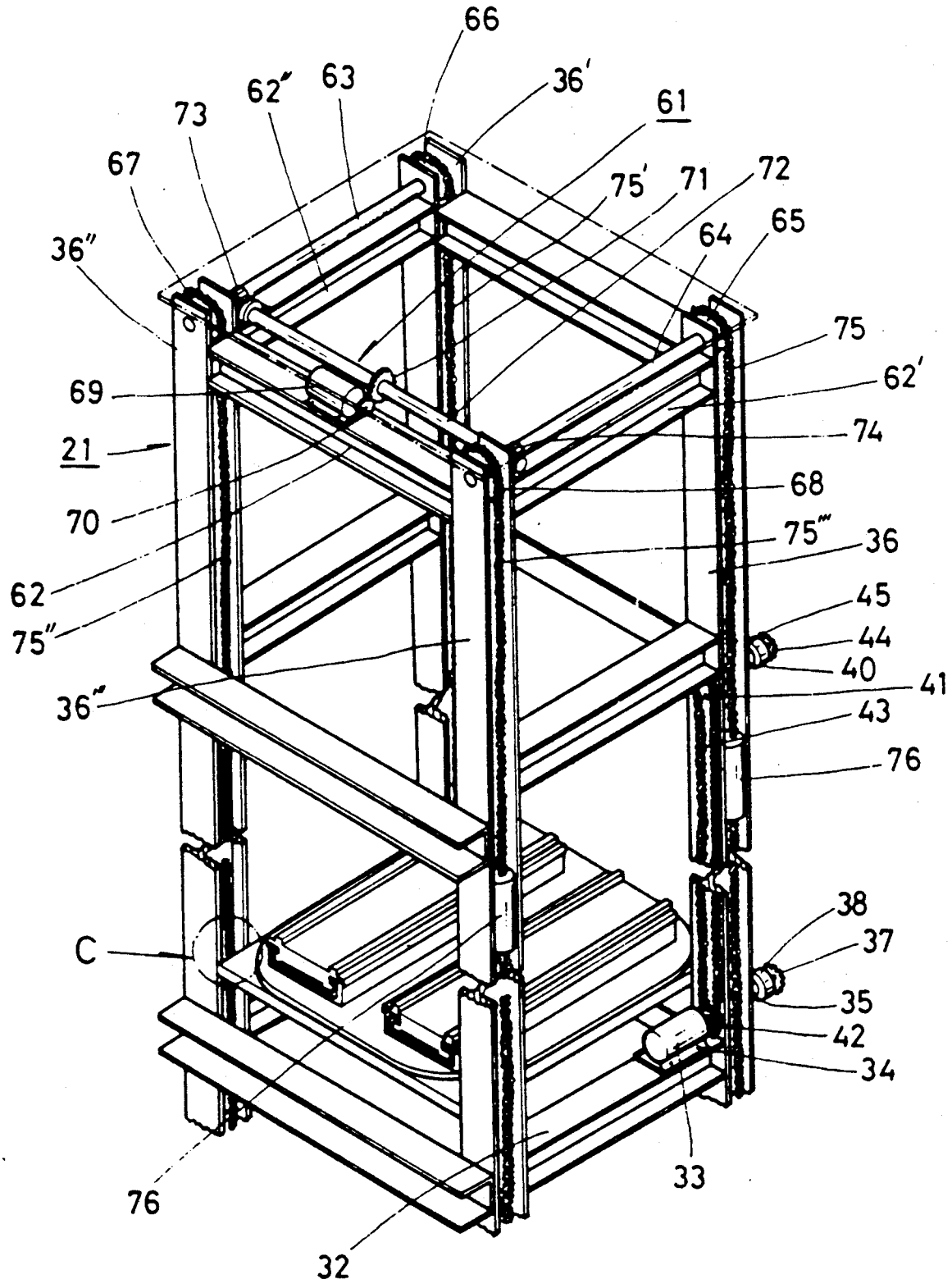
FIG. 2 is a schematic perspective view of the cage, as shown in FIG. 1.
Figure 3:
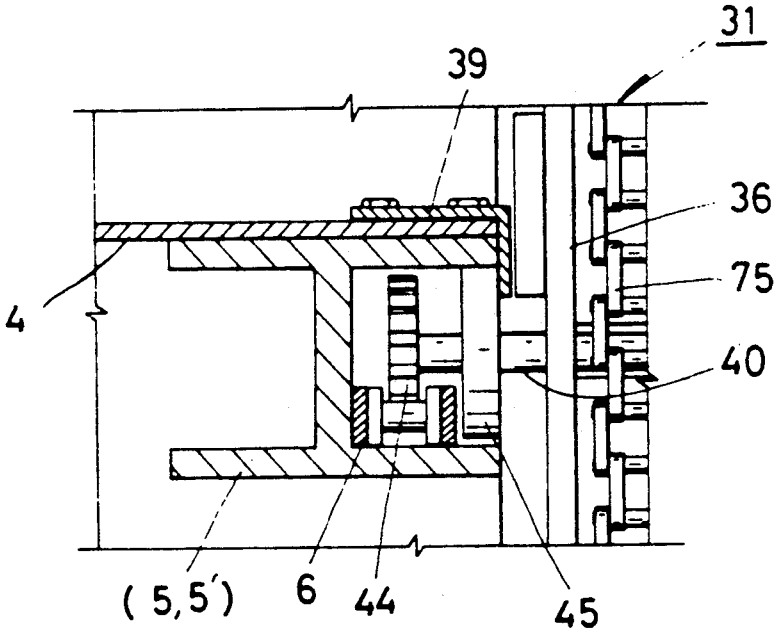
FIG. 3 is a sectional view along line A-A in FIG. 1 for illustrative purposes showing the means for shifting right and left.

First, the means for shifting right and left 31 is shown in FIG. 2 and FIG. 3. This means 31 includes a motor 33 for driving which is bolted to the shaped steel construction of said cage 21 at the same position that the chain 6 for driving is installed. The shaft 35 of motor 33 is pierced through vertical H beam 36. A sprocket 37 is fixed to the end of said shaft 35 and is in mesh with the chain 6 installed at the inner part of said horizontal H beams 5,5'. Accordingly, when the shaft 35 of the motor 33 is rotated, sprocket 37 shifts the chain 6 to the right and left, thereby freely guiding cage 21 by the guide rail 2 along one side of the parking installation 1. Additionally, a roller 38 is provided and axially fixed to the shaft 35, positioned at the inner part of said horizontal H beam of which the chain 6 is installed. This roller 38 is to protect against bolting of the chain 6.

Guiding member of the T type 39 (FIG. 3) is also used to protect against bolting of the chain. This guiding member 39 is mounted and fixed to the ends of said horizontal H beams 5,5'. The means for shifting right and left 31, as shown in FIG. 2, is installed in two places, because the means for shifting right and left 31 is installed in accordance with the number of chains 6 Accordingly, an extra shaft 40 for driving is fixed through vertical H beam 36. Sprockets 41, 42 are connected together and fixed to the shaft 35 of motor 33 via chain 43. Accordingly, the torque of said motor 33 is transferred to the shaft 40 for driving, via the chain 43. Similar to the assembly on shaft 35, the shaft 40 includes a sprocket 44 and a roller 45 for protecting against bolting of the chain 6.

Means for shifting right and left 31, as explained above, performs the shifting operation to the right and left, along one side of the parking installation 1. Sprockets 37, 44 mesh with chain 6 installed in an inner part of said horizontal H beams 5, 5'. The sprockets 37, 44 receive the torque of the motor 33 when actuated, and accordingly, said chain 6 is shifted right and left. Furthermore, the rollers 38, 45 mounted on shafts 35, 40 are in contact with the H beam 5,5' (see FIG. 3).

The chain 6 installed within the inner part of said horizontal H beams 5,5' cannot bolt because it is supported by said guide member 39 of the T type, and it rotates in accordance with the shifting of the cage. Therefore, a sudden accident caused by the bolting of chain 6 from sprockets 3 ,44 or caused by shaking during shifting of said cage 21 is prevented, and the movement of shifting is performed safely and accurately along the guide rail 2.

Figure 9:
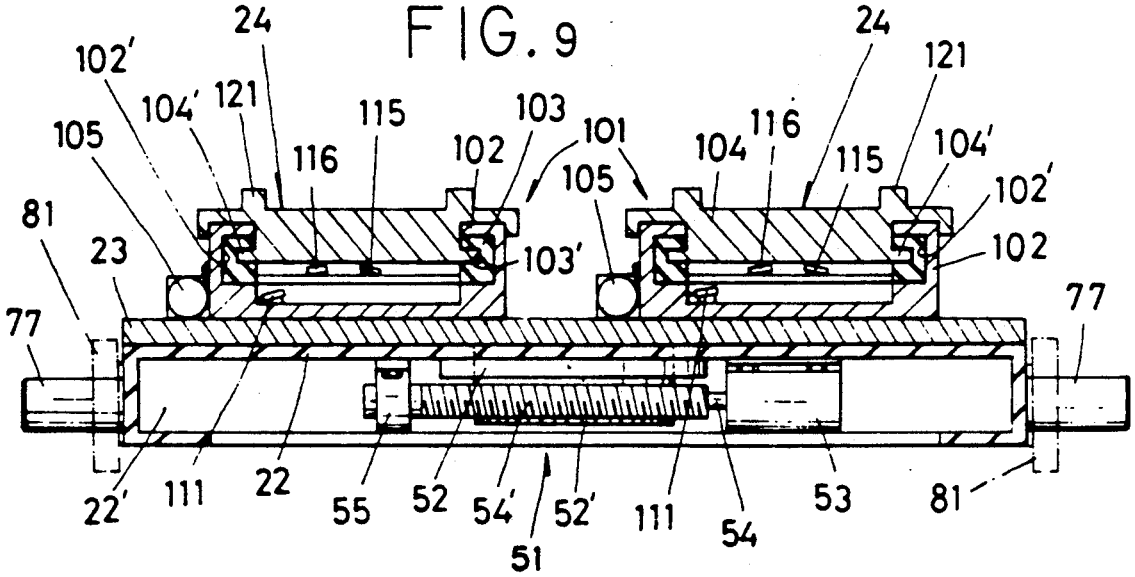
FIG. 9 is a magnified sectional view along line E—E shown in FIG. 8.

The means for rotating the table 51 is shown in FIG. 9. The means for rotating the table 51 is installed in the inner unoccupied space 22' within the rectangular foundation member 22 for fixing. An a is 52 for fixing, having the proper diameter, is passed through said foundation member 22 and is fixed to the lower side thereof, at the center of the table 23. A worm gear 52' is molded upon the radial surface of the lower portion of the axis 52, and a driving motor 53 is mounted in said space 22'.

The motor 53 is fixed to the foundation member 22 by a proper means for fixing, and the shaft 54 of said motor 53 connects to a fixed means for supporting 55. The radial surface of said shaft 54 is molded to form a worm gear 54' which meshes with said worm gear 52', whereby, the torque of said motor 53 is transferred to the table 23 through axis 52. When the axis 52 is rotated, the angle of rotation of said table 23 is determined according to the driving of the motor, if necessary, the table 23 may be rotated 90 degrees or 180 degrees to deliver and deposit the automobiles smoothly. Also, according to the imposed rotation, the pallet 24, fixed to table 23, is moved to the proper position for delivering and depositing, regardless of the direction of the front, back, and two sides of the foundation of the parking installation 1. Automobiles are delivered and deposited smoothly by squaring the pallets 24 with the loading spaces 3 by rotating the table 23.

Previously, problems have occurred in attempting to square the fixed pallets with the position of the automobiles. This problem had previously been overcome by installing extra large turntables on the access road of the parking installation, but the present invention provides a system which is economic and effective.

Figure 6:
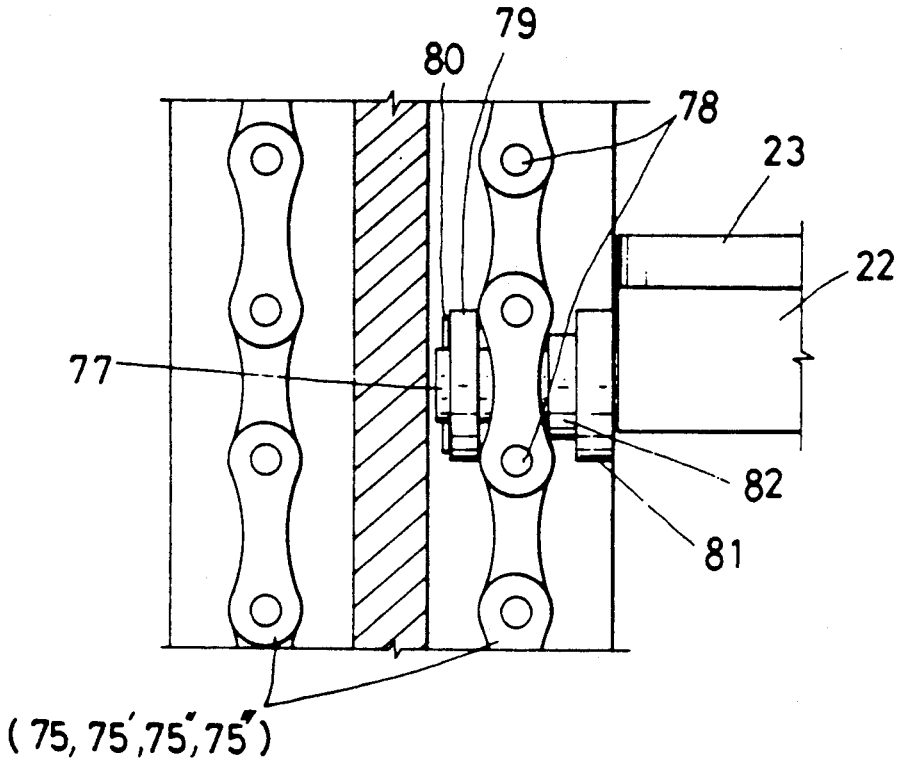
FIG. 6 is a magnified sectional view of area C shown in FIG. 2, showing the state of the fixing foundation member which is installed in a cage.
Figure 8:
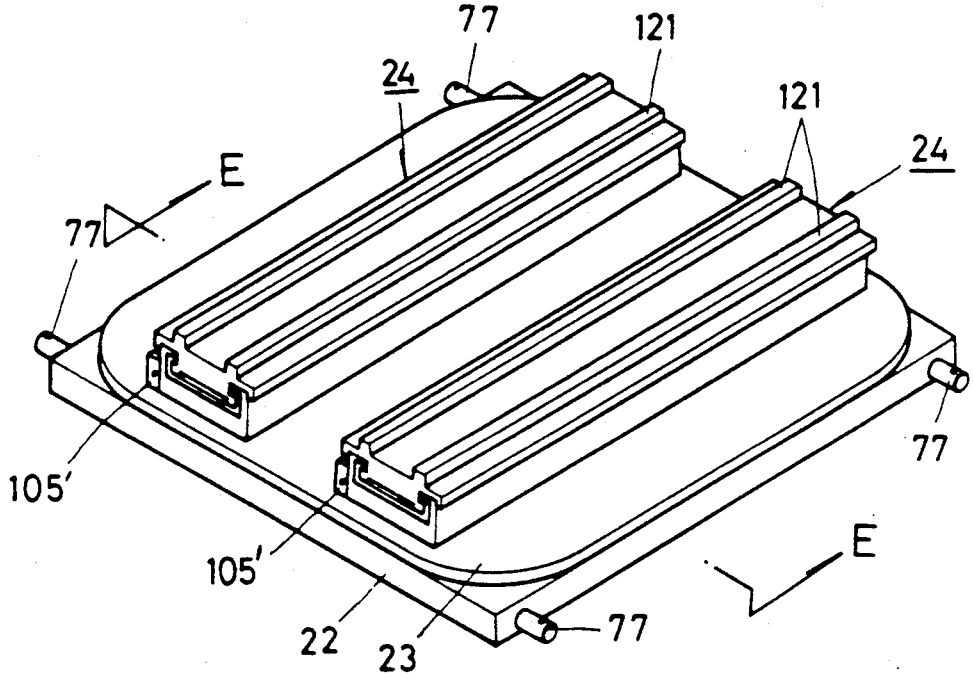
FIG. 8 is a perspective view of the fixing foundation member included within the cages.

The means for shifting up and down 61 is shown in FIG. 2, FIG. 6 and FIG. 8, which mainly comprises the ends of shaped steel beams 36, 36', 36'', 36''' for vertical supporting, and the upper shaped steel beams 62, 62', 62'' for horizontal supporting. On the upper horizontal beam 62'', side axis 63 said vertical beams 36, 36''' along upper horizontal beam 62. Sprockets 65, 66, 67, 68, are fixed to the two terminal ends of each connecting axis 63, 64 mounted through the vertical beams. On the upper horizontal beam 62, a motor 69 for driving is mounted, a shaft 72 being used to transfer the torque of said motor 69 via gears 70, 71 to connecting axis 63, 64, as described below.

The two ends of said shaft 72 are mounted to be crossed mutually and vertically with each connecting axis 63, 64. Worm gears 73, 74 are molded and mounted on the ends of the shaft 72, and accordingly, the torque of said motor 69 is transferred to axis 63, 64 through gears 70, 71 on shaft 72.

The sprockets 65, 66, 67, 68 are positioned on the inner center of said vertical beams 36, 36', 36'', 36'''. These sprockets 65, 66, 67, 68 are mounted to mesh with chains 75, 75', 75'', 75''', and extra sprockets 65', 66', 67', 68' 15 (see FIG. 4) are mounted on the inner part of the bottom of said vertical beams 36, 36', 36'', 36'''. The extra sprockets 65', 66', 67', and 68' also mesh with said chains 75, 75', 75'', 75''', accordingly chains 75, 75', 75'', 75''', are mounted from the top to the bottom of vertical beams 36, 36 , 36'', 36'''.

The means for shifting up and down 61 includes a weight 76 of proper mass for lessening the weight, mounted between said chains 75, 75', 75'', 75''', whereby the operating load of motor 69 is lessened when said foundation member 22 shifts up and down. Additionally, a pin 77 for fixing is molded so as to protrude from the foundation member 22 (see FIGS. 6 and 8). A pin 77 is placed through each of said chains 75, 75', 75'', 75''', positioned on the vertical beams 36, 36', 36'', 36'''. By fixing pin 77 between pins 78, said pins 78 making up chains 75, 75', 75'', 75''', with a washer 79 and a pin 80 for fixing, the foundation member 22 is firmly fixed to each of the chains 75, 75', 75'', 75'''. A roller bearing 81 and a washer 82 are provided in the occupied space formed by each of the chains 75, 75', 75'', 75''', the roller bearing 81 and washer 82 positioned between said pin 77 and said foundation member 22. The roller bearing 81 is adjacent to the inner face of each said vertical beams 36, 36', 36'', 36 ''', accordingly, said foundation member 22 may be safely shifted up and down.

Means for shifting up and down 61 as described above makes each of said chains 75, 75', 75'', 75''' move mutually, and allows for the free shifting up and down of the foundation member 22, because foundation members are mounted in the inside of cage 21 and firmly fixed to each said chains 75, 75', 75'', 75''' by molded pin 77 on the corner of said member 22. The operation of shifting up and down is performed such that the roller bearing 81 is rotated in contacting with the face of each said vertical beams 36, 36', 36'', 36'''. Accordingly, the shifting up and down operation is performed safely while protecting against the shake caused by the unbalanced weight of an automobile being delivered or an outer impulse.

Also, the shifting up and down of the foundation member 22 is effectively performed with lower electric power consumption, because the load of said motor 69 is lessened by the cage 21 delivers and deposits an automobile to a position directed arbitrarily.

Figure 4:
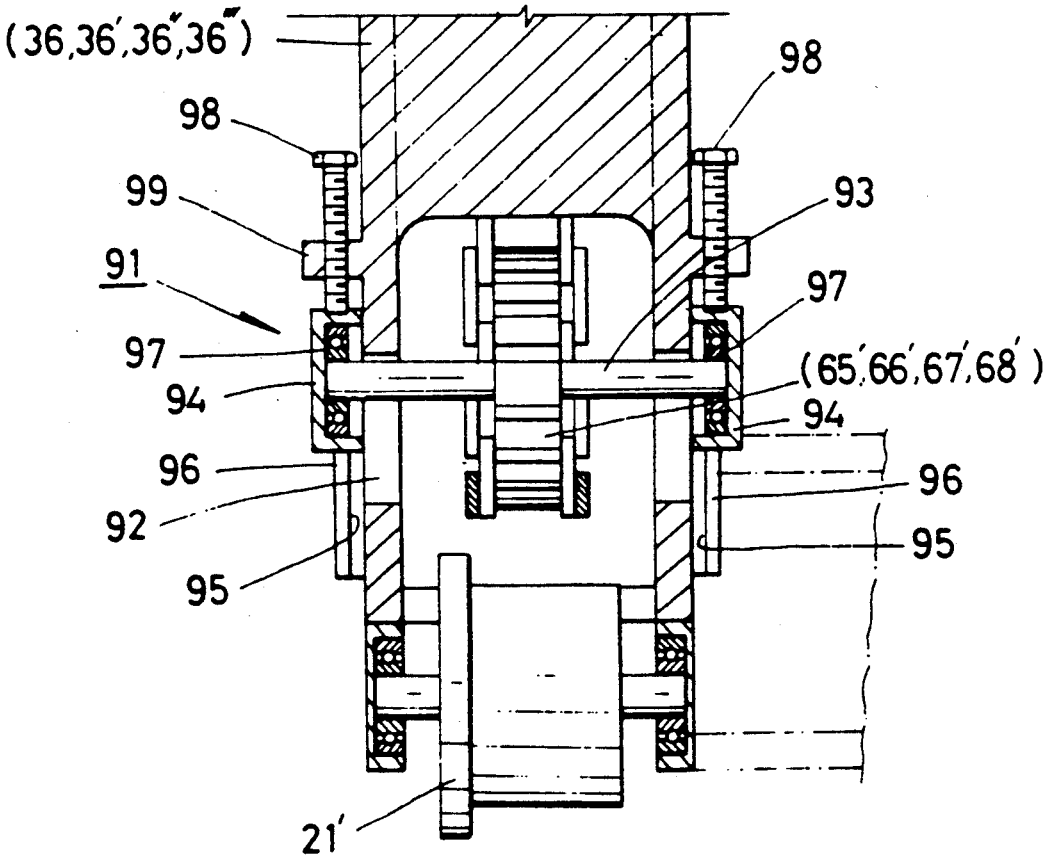
FIG. 4 is a magnified sectional view of area B shown in FIG. 1, illustrating the means for controlling the tension of the chains FIG. 5-(I) is a schematic plane view illustrating a pallet taken from a cage.

Means for controlling the tension of the chain 91, as shown in FIG. 4, is to control the tension of said chains 75, 75', 75'', 75''', in mesh with each of the sprockets (65, 65'), (66, 66'), (67, 67'), (68, 68.) fixed to the upper and bottom ends of said vertical beams 36, 36', 36'', 36''' by properly shifting up and down. Each sprocket 65', 66', 67', 68' is fixed to the bottom of said each vertical beams 36, 36', 36'', 36'''. On the two sides on the bottom of said vertical beams 36, 36', 36'', 36''', an unoccupied space 92 for the movement of a rotary axis of a sprocket is formed. The shaft 93 of each sprocket 65', 66', 67', 68' is mounted through the unoccupied space 92 which is open at the two ends of the shaft 93 A case 94 for controlling is fixed to the two outer sides of said vertical beams 36, 36', 36'', 36''', the case being moved by using rotary axis 93 as a pivot. The two side faces of case 94 for controlling are fixed to a guide groove 95 of a guider 96 for support, and accordingly, as said case 94 is guided by groove 95 of said guider 96, the case 94 can be shifted up and down.

The rotary axis 93 is freely rotatable by two inserted bearings 97 mounted on the inner face of the case 94. A protrusion 99 for supporting is molded the proper distance from said case 94, and a bolt 98 for controlling is bolted to the protrusion 99. The bottom of said bolt 98 is in contact with the upper center of said case 93. Thus, the means for controlling the tension of chain 91 is to provide accurate movement of chains 75, 75', 75'', 75''' and to prevent the chains from being lengthened by the weight of heavy automobiles. When said chain 75, 75', 75'', 75''' is lengthened during movement with the weight of an automobile, the tension of chains 75, 75', 75'', 75''' can be easily controlled by the downward action of bolt 98 on the rotary axis fixed to sprockets 65', 66', 67', 68'.

One primary feature of the present invention is the means for expansion and stretching 101, as shown in FIG. 5, FIG. 7, FIG. 8, FIG. 9. The means for expansion and stretching 101 is used to put an automobile from the cage onto the loading space 3, in the proper position. The means 101 is used to pick up an automobile to be parked from an access road into said cage 21, and putting the automobile into the loading space 3 when the cage 21 is stopped at the loading space 3.

Pallets 24, as best shown in FIG. 9, are fixed to the table 23 which is able to rotate 360° to the right and left on the foundation member 22 in the cage 21. The pallets 24 include a fixing frame 102 to be fixed the table 23, a middle frame 103, which is freely able to perform attraction and stretching to the back and front. Two side ends of the middle frame 103 are supported in a groove 102' in frame 102, and a loading frame 104 is supported by protrusion 104' in the groove 103 of the two bottom side terminals of said middle frame 103. Driving motors 105, 105' are mounted on said fixing frame 102 toward mutually opposite directions.

Figure 5A:
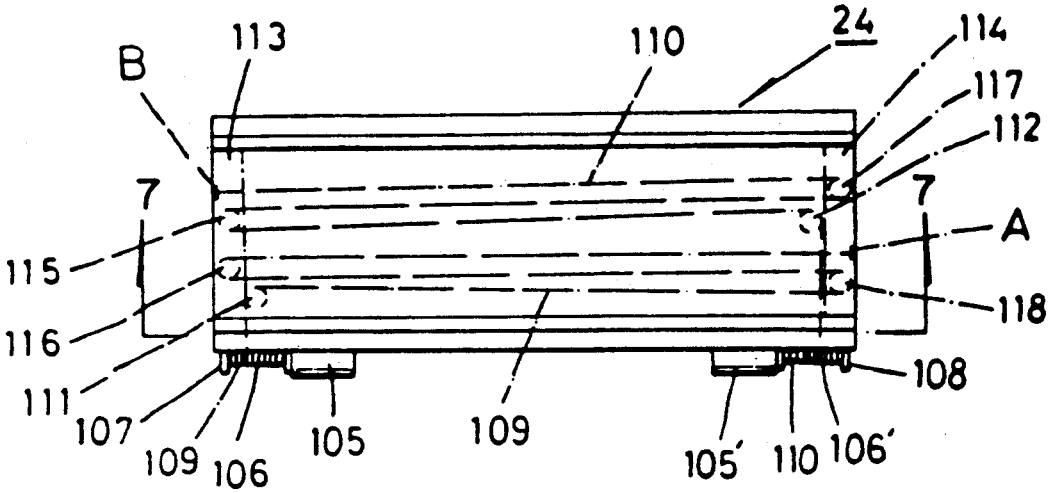
FIG. 5-(II) is a view showing the movement of a pallet to the right and the left.
Figure 5B:
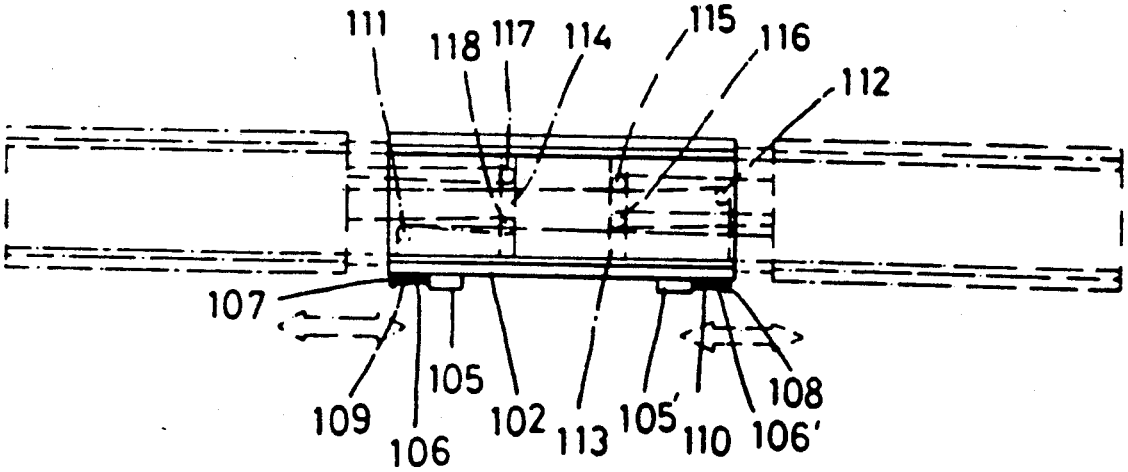

Shafts 106, 106' (see FIG. 5 (I) and FIG. 5 (II)) of each said motor 105, 105', are made in the proper length, and likewise, each supporting case 107, 108 is mounted in the proper position to support said shafts 106, 106 . wires 109. 110 are wound in proper length and the terminal end of said wires 109, 110 are passed through the inner side of said fixing frame 102 to pulleys 111, 112 The pulleys 111, 112 are freely rotating and mounted on said fixing frame 102 at a slope in accordance with the direction of wire pulled against the pulley 111, 112.

The foundations 113, 114 for the pulleys are located on the middle frame 103, positioned within the inner side of the fixing frame 102. Pulleys 115, 116 are positioned on said foundation 113, and pulleys 117, 118 are positioned on said foundation 114, mounted at the proper slope for freely rotating with each of wires 109, 110 drawn out from the inner side of fixing frame 102. Wire 109 passes through pulley 111 fixed to fixing frame 102, then through pulley 118 fixed to said foundation 114 for pulley, then to pulley 116 fixed to foundation 113. After pulley 116, the terminal of said wire 109 is firmly fixed to part A of loading frame 104. Likewise, wire 110 passes through pulley 112 fixed to fixing frame 102. through pulley 115 fixed to foundation 113, through pulley 117 fixed to foundation 114, and finally, the terminal of wire 110 is firmly fixed to part B of loading frame 104. Accordingly, by driving each of motors 105, 105', the movement of attraction and stretching to the back and front of middle frame 103 and loading frame 104 is performed freely, as shown in FIG. 5(II).

Figure 7:
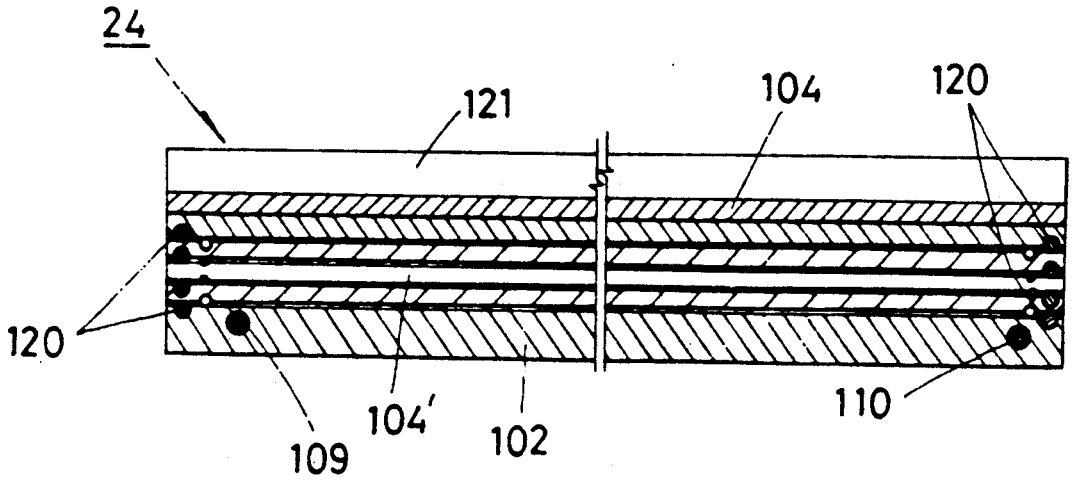
FIG. 7 is a sectional view along line D—D in FIG. 5, showing the state in which a pallet is attracted.

An intervening needle bearing 120, shown in FIG. 7, between the contacting faces of the fixing frame 102, middle frame 103, and loading frame 104, allows the movement of attraction and contraction of each frame 103, 104 to be performed without difficulty. On the upperside of loading frame 104, two loading members 121 with protrusions 104' of the proper width are fitted into groove 103', as shown in FIG. 9. The loading member 121 contacts the bottom frame of an automobile to be parked, and the automobile is shifted upward and deposited by the means for attraction and stretch 101. It is advantageous to provide two pallets 24 of the same type on the table 23 in the cage 21.

When motor 105 is driven to put an automobile into cage 21, as shown in FIG. 5 (II), middle frame 103 and loading frame 104 are stretched to the left, and fixing frame 102 remains as the center.

The operation of stretch discussed above is accomplished through the following steps:

Wire 109 is pulled by rotation of shaft 106 of motor 105, the length of wire 109 being fixed to part A through each of pulleys 111, 118, 116, and the length of wire 109 is shortened more and more. Accordingly, loading frame 104 and middle frame 103 are moved to the left. At the same time, wire 110, fixed to part B of fixing frame 104, is pulled through each of pulleys 112, 115, 117 and wound around the pulleys 112, 115, and 117. In this manner, the wire 110 on the shaft 106' of motor 105' is stretched so that loading frame 104 and middle frame 103 are moved.

To return the pallet to its original position after being put into a stretch, the motor 105' is driven by a control system, and the opposite operation to that described above is performed. Accordingly, the middle frame 103 and the loading frame 104 come back to their original position.

Likewise, by appropriate driving control of motors 105, 105', it is also possible for the middle frame 103 and the loading frame 104 to be stretched to the right, with the fixing frame 102 as the center. The operation is performed by driving motor 105' in the manner explained above for motor 105, although the opposite operation to that of the stretch to the left of the middle frame 103 and the loading frame 104 is performed.

The movement to the right and the left of middle frame 103 and loading frame 104 with fixing frame 102 as the center is performed without difficulty because of the presence of intervening needle bearings 120.

An automobile is put into cage 21 by pulling the loading frame 104 back to the fixing frame 102 when an automobile is loaded onto the loading frame 104 of pallets 24 Since the wires 109, 110 have enough tension and the terminal of each wire is fixed to parts A and B respectively of loading frame 104, the movement of attraction and stretching is accurately performed by pulling one wire around the shaft of the motor, while the other wire is drawn around the pulleys.

Figure 11:
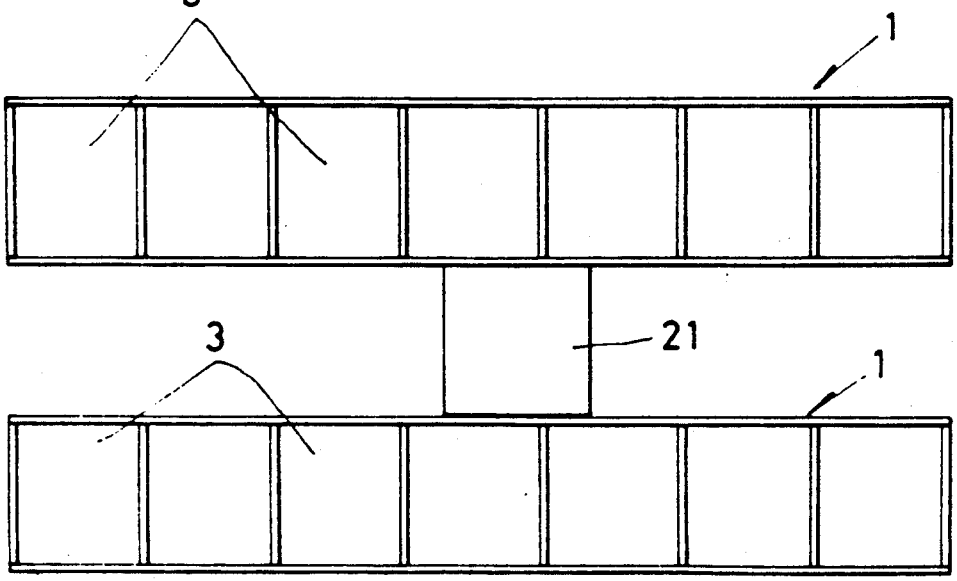
FIG. 11 is a plane view showing another embodiment of the present invention.
Figure 12:
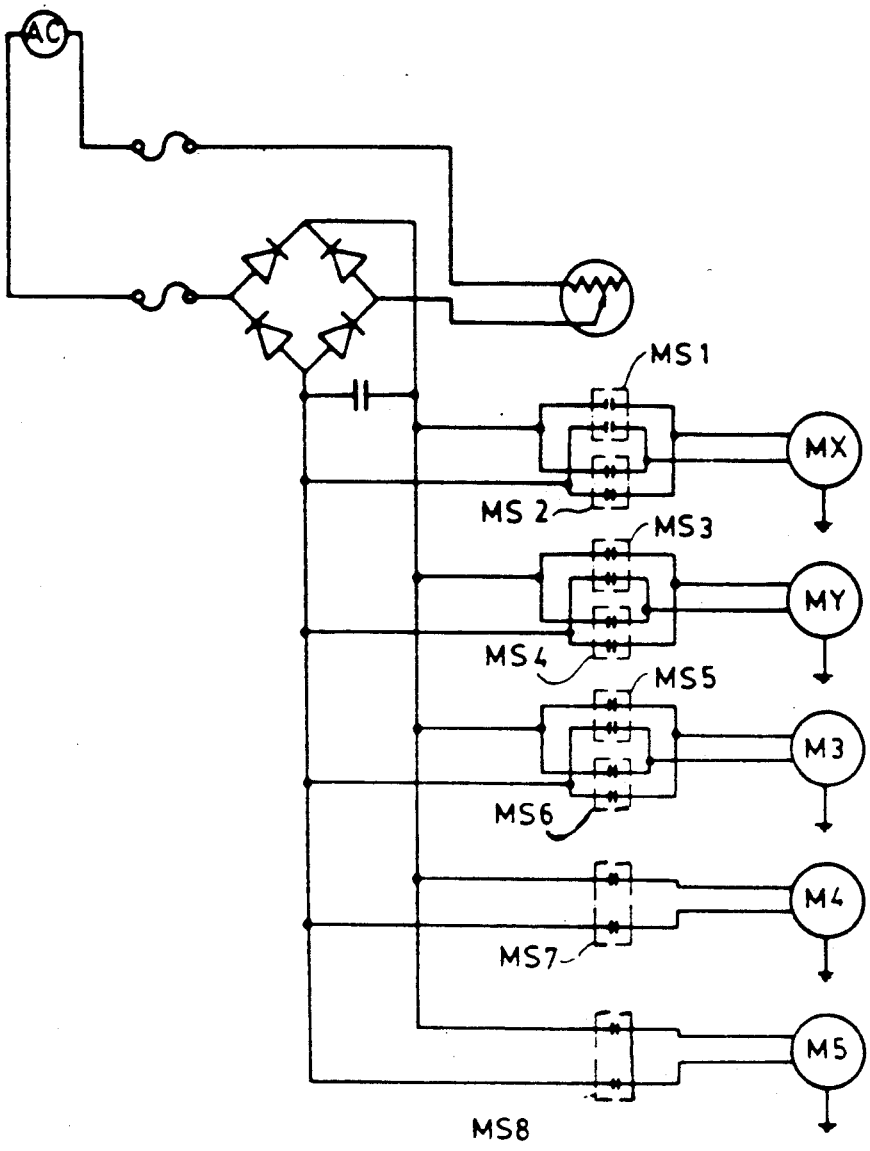
FIG. 12 is an electric circuit diagram showing the control system.

When an automobile is loaded on the loading frame 104 by stretching the pallets 24, after lifting the automobile somewhat with said means for shifting up and down 61, the automobile is pulled into cage 21 as loading frame 104 and middle frame 103 are contracted back to their original position. Thereafter, the automobile is loaded into the loading space 3, any of which loading spaces 3 may be chosen arbitrarily On the other hand, after parking, the automobile may be simply and effectively delivered to a proper access road, by loading an automobile from the loading space 3 into cage 21, and returning the cage 21 to the ground, thus delivering the automobile. FIG. 11 shows another embodiment of the present invention, wherein a parking installation 1 of the apartment type is installed on two sides of a cage type elevator 21. This allows the building to double the capacity for parking, while using a single cage 21. The cage shown in FIG. 11 is the same as that described above The various systems of the present invention include extra systems to sequentially and accurately control the operation of the parking installation. The construction and operation of the control system for the present invention, as shown in FIG. 12, comprises motors MX, MY for moving the means for shifting up and down and right to left in the direction of the X axis and the y axis, motor M" for rotating the table, and motors M. and M° for driving the pallet.

Figure 13:
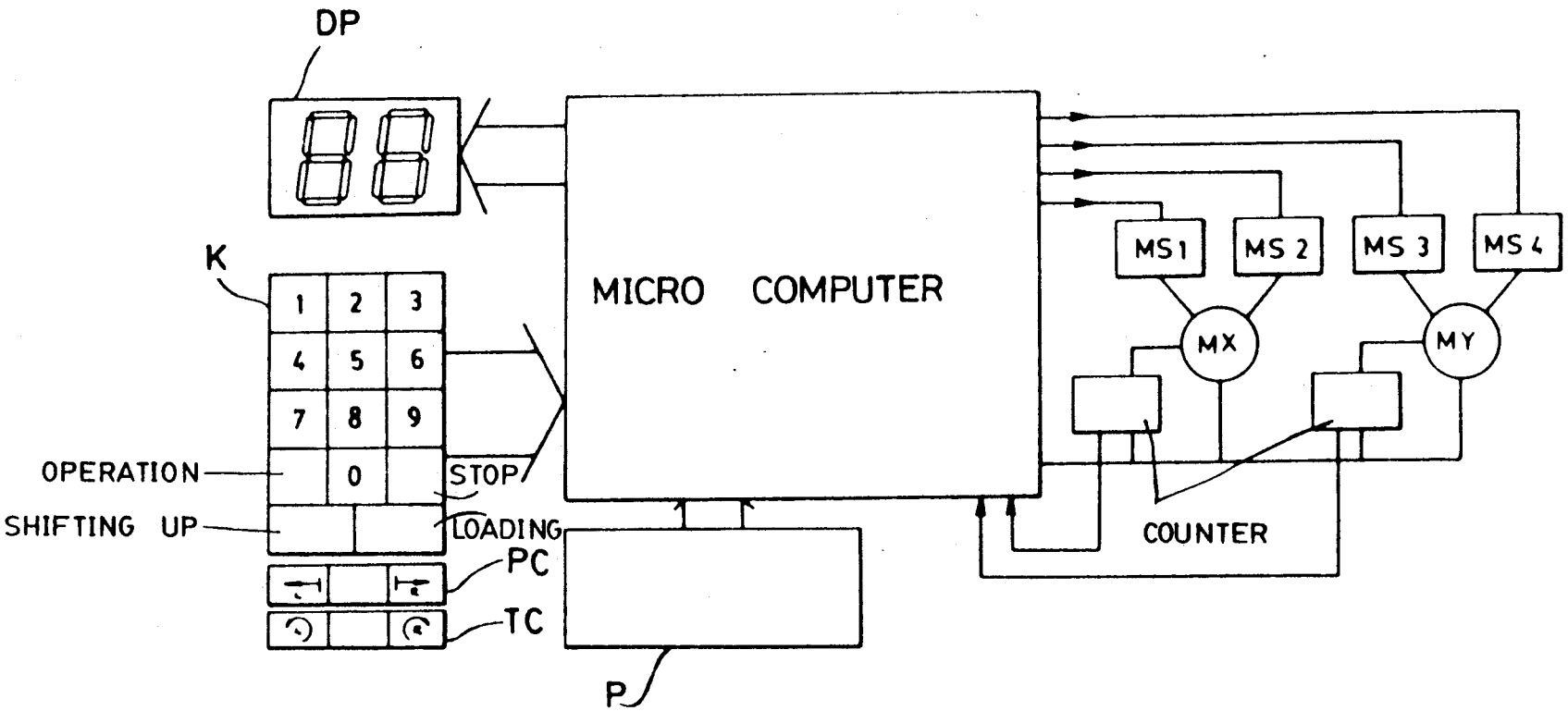
FIG. 13 is an explanatory diagram describing the main controlling operation.

The system for controlling the movement in the direction of the X axis and the y axis by the means for shifting up and down, as shown in FIG. 13, comprises a microcomputer as the main part of the control system, an electric power source, a key board K for operation to select the direction to be moved to, a displayer DP made up of 7-segment letters, switches $MS_1$-$MS_4$ to the direct of rotation of motors MX, MY, for movement in the X, Y directions, and a counter for detecting the number of rotations of said motor. These elements are connected to the microcomputer, as shown in the figure.

Figure 14:
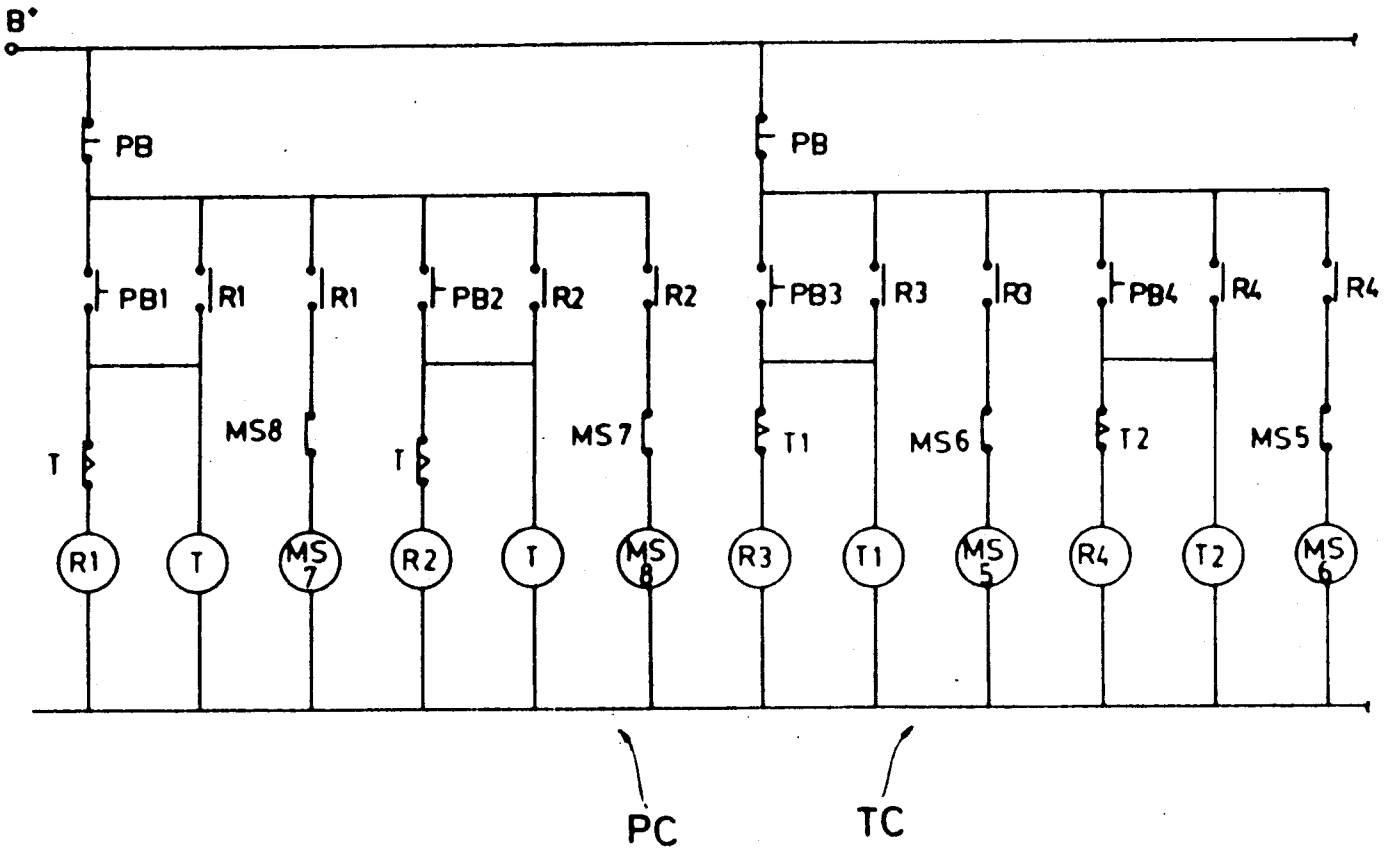
FIG. 14 is a sequential circuit diagram for describing the controlling of the pallets and tables.

The following relates to the control system for the table 23 and pallets 24. The reliability for table control and pallet control can be enlarged by separated construction and connection to a microcomputer in a half-automatic state. The control system for the table, as shown in FIG. 14, is made up of a timer for regular operation time, this timer is to be set up to correspond to the time required for the table to rotate 90° or 180°, and magnetic switches MS-5, MS-6 interlocked into the system to rotate in the reverse direction. Control system for the pallets, similar to that explained for the table system, is made up of a timer to control the time for operation of the pallets, and magnetic switches MS-7, MS-8 interlocked into the system. Since the technology of the control systems relating to FIG. 14 as shown is known to those skilled in the art, a detailed explanation has been omitted.

Figure 15:
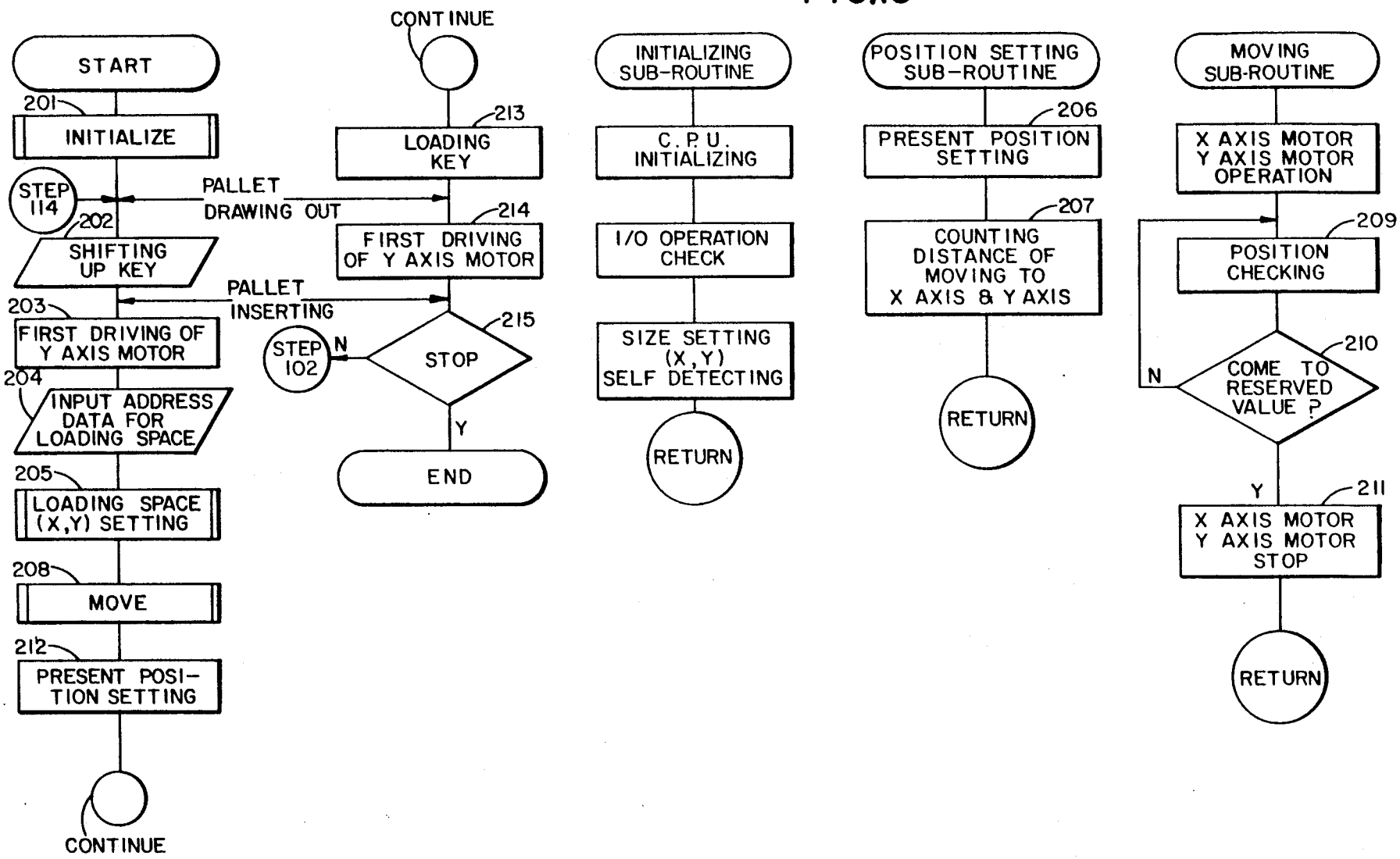
FIG. 15 is a flow chart diagram for describing the main control operation shown in FIG. 13.

Regarding the operation of the microcomputer as shown in FIG. 15, upon activation of the power source, the microcomputer initializes the systems (step 201), and the system is prepared for operation. When an automobile to be parked approaches the cage, the operator extends the pallet beneath the bottom of the automobile by operating the control system for pallets. When the pallets are stretched to their maximum length, the timer discontinues the operation, and the pallet stops. Next, the shifting up key (step 202) is pushed, and motor My for the y axis is driven first (step 203), thus lifting the automobile from the earth. The operator controls the pallets to pull them back into the cage, and when the pallet is put back onto the table, the operator inputs an address for a loading space to park the automobile by the keyboard (step 204). At this time, the address input into the system is displayed on the displayer. Then, by pushing the operation key on the keyboard, the address of the loading space is set (step 205). The C.P.U. of the microcomputer checks (step 206) the position keyed in and counts the distance of movement along the X a is and the y axis by comparing the distance moved with the input address (step 207). Accordingly, motor MX and motor My are driven for the proper time simultaneously (step 208).

Continuous position checking is performed (step 209) and when the reserved value is reached (step 210), the motor for movement along the X axis and the motor for movement along the y axis are stopped (step 211). The motors stop in the state where the vertical position allows enough space for the operation of the pallet. The operator controls the pallet, stretching it out into the loading space, and if the operating key for loading is activated (step 213), the driving motor for the y axis is first driven, and the automobile is placed on the bottom of the means for parking. After the automobile arrives safely at the bottom of the means for parking, the operator puts the pallet back into the table by controlling said pallet system, and then the operation is ended (step 215). The cage is returned to its original position by a minimum path length.

If the next command is not an input for the motor for the X axis, the motor for the X-axis will not drive, but only the motor for the y axis will drive and, accordingly, the minimum movement is performed in the vertical direction (step 204). Also, if the address for the next parking location is input, the cage is moved by the operator's control from the first address directed to the next address to which it is directed. Accordingly, the operator continuously controls the parking operation.

What is claimed is:

1. A parking installation apparatus comprising:

an apartment type solid parking installation with a plurality of floors and loading spaces, said loading spaces assembled from mutually crossed shaped steel beams;

a first drive chain mounted to a horizontal shaped steel beam, a location of the first drive chain being determined by a height of the parking installation;

a wire and an extensible spring connected to one end of said drive chain, said extensible spring fixed to one of said shaped steel beams;

a cage, wherein a width of the cage corresponds to a width of said loading spaces, said cage extending above a highest floor of said parking installation;

a guide rail for moving the cage along one side of said parking installation;

first means connected to said cage and said first drive chain for shifting said cage along said one side;

means for rotating a table, said table connected to said cage; and at least one pallet mounted within said cage, said pallet being extendable out of said cage for delivering and depositing an automobile into said loading space.

2. An apparatus as defined in claim 1, wherein said first means includes a motor fixed to a horizontal shaped steel beam of the cage, wherein a shaft of said motor is passed through a vertical shaped steel beam of the cage;

a first sprocket connected to said shaft, said first sprocket located so as to mesh with said first drive chain;

a first roller to protect against bolting of said drive chain, said first roller being connected to said shaft;

a first guide member to protect against bolting of the first drive chain;

a second sprocket connected to said shaft of said motor;

a second shaft passing through said vertical shaped steel beam of said cage, said second shaft including a third sprocket and a fourth sprocket;

a chain connecting said second and third sprockets, thereby transferring the torque of said shaft of said motor to said second shaft;

said fourth sprocket located so as to mesh with a second drive chain, said second drive chain being vertically displaced from said first drive chain; and a second roller and a second guide means to protect against bolting of said second drive chain.

3. An apparatus as defined in claim 1, wherein said means for rotating said table includes:

a table axis molded onto the bottom and center of said table, the table axis passing through a foundation member, wherein a radial surface of said table axis includes a worm gear;

said foundation member defining a space, wherein a motor is mounted in said space, and a shaft of said motor including a worm gear to mesh with the worm gear of the radial surface of the table; whereby torque of said motor is transferred to said table, enabling said table to be rotated to any desired position.

4. An apparatus as defined in claim 1, further including a means for shifting the cage up and down, said means for shifting up and down including:

connecting shafts mounted along two opposite upper horizontal shaped steel beams which make up said cage, the ends of said connecting shafts passing through vertical shaped steel beams;

a sprocket fixed to each end of each said connecting shafts, thereby providing four sprockets;

a motor mounted on an upper horizontal beam located between said two opposite upper horizontal shaped steel beams;

a drive shaft with two gears to receive torque from said motor, the ends of said drive shaft including worm gears, said drive shaft worm gears meshing with a worm gear on each connecting shaft, thereby transferring the torque of said motor to said connecting shafts;

four vertical chains in mesh with said four sprockets and an extra set of four sprockets, said extra set of four sprockets at another end of said vertical shaped steel beams;

a weight on each said vertical chains;

wherein said table is mounted on a foundation member, said foundation member including pins at each corner, each pin being inserted into one of said vertical chains, said pins being fixed to said vertical chains by a roller bearing and a washer.

5. An apparatus as defined in claim 1, further including a means for attraction and stretching of said pallets, said means for attraction and stretching comprising:

a fixed frame mounted onto said table;

a middle frame, two side ends of said middle frame being fit into a groove on inner walls of said fixed frame;

a loading frame including a protrusion which is supported within a groove of said middle frame, said loading frame having a loading member on its upper surface;

two loading frame driving motors mounted on said fixing frame;

a first wire, wound on the shaft of one of the motors, said first wire passing through said fixing frame, passing around a pulley which is mounted at a slope, and an end of said first wire being fixed to a part of said loading frame;

a second wire, wound on the shaft of the other motor, an end of said second wire being fixed to a part of said loading frame, whereby attraction and stretching of said pallets is accomplished by driving each motor separately;

and needle bearings, located between the contacting frame of said fixing frame, middle frame, and loading frame.

* * * * *